US012024865B2

(12) United States Patent
Qian

(10) Patent No.: US 12,024,865 B2
(45) Date of Patent: Jul. 2, 2024

(54) FAUCET SHELL AND FAUCET MADE OF SUCH SHELL

(71) Applicant: Wenzhou Yisheng Sanitary Ware Co., Ltd., Wenzhou (CN)

(72) Inventor: Shizhu Qian, Wenzhou (CN)

( * ) Notice: Subject to any disclaimer, the term of this patent is extended or adjusted under 35 U.S.C. 154(b) by 205 days.

(21) Appl. No.: 17/825,144

(22) Filed: May 26, 2022

(65) Prior Publication Data

US 2023/0061897 A1 Mar. 2, 2023

(30) Foreign Application Priority Data

Aug. 31, 2021 (CN) ..... 202122090022.X

(51) Int. Cl.
*E03C 1/04* (2006.01)
*E03C 1/02* (2006.01)

(52) U.S. Cl.
CPC ..... *E03C 1/0404* (2013.01); *E03C 2001/026* (2013.01)

(58) Field of Classification Search
CPC ..... E03C 1/0404
See application file for complete search history.

(56) References Cited

U.S. PATENT DOCUMENTS

| | | | | |
|---|---|---|---|---|
| D994,843 | S * | 8/2023 | Gessi | D23/238 |
| 2017/0247865 | A1* | 8/2017 | Nikles | F16K 19/006 |
| 2021/0102360 | A1* | 4/2021 | Tzeng | F16K 19/006 |
| 2023/0106648 | A1* | 4/2023 | Philipps | E03C 1/0403 4/677 |

* cited by examiner

*Primary Examiner* — Christine J Skubinna
(74) *Attorney, Agent, or Firm* — Sandy Lipkin

(57) ABSTRACT

This invention discloses a faucet shell, comprising a cylinder body formed by cutting tubular profile, and a cover formed by punching from sheet plate. The outer edge of the cover is welded to the upper end face of the cylinder body or inner wall of the upper end of the cylinder body. A through hole is arranged in the center of the cover, and a valve element mounting cylinder is welded at the through hole. This invention can effectively reduce supporting facilities required, production processes and dependence on large production equipment so as to reduce production cost and exhibit beautiful appearance.

7 Claims, 8 Drawing Sheets

FAUCET SHELL AND FAUCET MADE OF SUCH SHELL

REFERENCE TO PRIOR APPLICATION

This application claims priority to Chinese Patent Application CN202122090022.X, filed on Aug. 21, 2021, which is incorporated herein by reference.

FIELD OF THE INVENTION

The present invention relates to the field of bathroom accessories, in particular to a faucet shell and faucet made of such shell.

BACKGROUND OF THE INVENTION

Faucet series play a major part in bathroom accessories, and faucets in their sub-series have various small types. Existing faucet shell castings are almost solid and produced with a large quantity of materials. Their valve element mounting positions are generally arranged integrally with shells, requiring valve element mounting positions and connecting structure of inlet and outlet pipes to be processed on the shell after casting with extremely high material and production costs. In addition, the outer wall of faucet shells needs to be processed with complicated technologies, increasing production steps, costs and labor intensity, even transportation cost due to heavier faucet shells.

SUMMARY OF THE INVENTION

In order to solve the above problems, the present invention is proposed to provide a faucet shell and faucet made of such shell that can effectively reduce supporting facilities required, production processes and dependence on large production equipment so as to reduce production cost and exhibit beautiful appearance.

To solve the above problems, the present invention provides the following technical scheme: a faucet shell, comprising a cylinder body formed by cutting tubular profile, and a cover formed by punching from sheet plate. The outer edge of the cover is welded to the upper end face of the cylinder body or inner wall of the upper end of the cylinder body. A through hole is arranged in the center of the cover, and a valve element mounting cylinder is welded at the through hole.

The above structure shows that the cylinder body is formed by directly cutting from tubular profiles such as stainless-steel pipe and aluminum pipe, and the cover is formed by punching from stainless steel plate, aluminum plate or other plates. The outer edge of the cover is preferably welded to the inner wall of the cylinder body at its upper end and kept neatly flush with the end face of the cylinder body. The through hole is arranged in the center of the cover for welding the valve element mounting cylinder. Since the positional relationship between the valve element mounting cylinder and the through hole can be adjusted by movement before assembly, the overhangs of the valve element mounting cylinder can be controlled according to different faucet models to ensure the overall aesthetics and coordination after faucet assembly and avoid one-mold-one-object defect existing in casting process; the overall faucet shell is formed by welding the cover punched from sheet plate to effectively avoid many problems in existing faucet shell casting process and follow-up overall surface polishing and electroplating, such as complicated production process, high production cost, and low production efficiency, thus to effectively reduce production cost, lower finished faucet prices, and increase competitiveness while the appearance, performance and corrosion resistance remain unchanged.

Further, the present invention proposes that a welding cylinder formed by punching and drawing material in the hole is arranged at the through hole in the center of the cover, the welding cylinder extends toward the lower end of the cylinder body, the outer wall of the valve element mounting cylinder is welded to the welding cylinder, and an opening is arranged at one end of the valve element mounting cylinder facing the upper end face of the cylinder body.

The above structure shows that when the through hole is punched out from the cover, the welding cylinder is produced by reasonably drawing the material in the through hole for welding the valve element mounting cylinder, so as to ensure the overall strength and rigidity of the cover, and the valve element mounting cylinder is used for mounting the valve element.

Further, the present invention proposes that a closing is arranged at the extended end of the welding cylinder, the outer wall of the valve element mounting cylinder is welded to the closing, and the outer wall of the valve element mounting cylinder is spaced apart from the inner wall of the welding cylinder.

The above structure shows that the closing can ensure the smooth welding of the welding cylinder to the valve element mounting cylinder, and reduce the risk of penetration welding.

Further, the present invention proposes that the valve element mounting cylinder is formed by cutting tubular profile, a bottom cover is welded to one end of the valve element mounting cylinder facing the lower end of the cylinder body, inlet pipes are welded to the bottom cover, a water outlet is arranged on the side wall of the valve element mounting cylinder, and the water outlet is arranged in the welding cylinder.

The above structure shows that the valve element mounting cylinder formed by cutting tubular profile can reduce production cost, and that with appropriate length and diameter can be used according to actual specifications of the valve element. The bottom cover is integrally welded to the valve element mounting cylinder to form a cavity for placing the valve element later. The valve element is placed against the bottom cover and connected to the inlet pipes thus to control the on-off of water flow between the inlet pipe and the water outlet to allow water to flow from the water outlet into the interlayer between the welding cylinder and the valve element mounting cylinder; the inlet pipes comprise a cold water pipe and a hot water pipe. A hot and cold water valve element can be used to adjust the temperature of outlet water to match hot and cold water faucets.

Further, the present invention proposes that a valve element locating hole formed by punching is arranged on one side of the bottom cover facing the inner cavity of the valve element mounting cylinder.

The above structure shows that the valve element locating pole matches the locating pin at the bottom of the valve element to avoid mistakes in the installation of the valve element. Compared with existing drilling method, the punching method can directly form valve element locating pole saving time and effort.

Further, the present invention proposes that a groove is arranged around the through hole or the welding cylinder on one end of the cover facing the upper end of the cylinder body.

The above structure shows that the end face groove is used to install sealing ring when the faucet is assembled later.

Further, the present invention proposes that a bottom cover formed by punching from sheet plate is arranged at the lower end of the cylinder body and welded to the end face or inner wall of the cylinder body at its lower end; a connecting cylinder formed by punching and drawing material in the hole is arranged in the upper center of the bottom cover; the connecting cylinder extends toward the upper end of the cylinder body; the inner wall of the connecting cylinder is provided with connection threads.

The above structure shows that the bottom cover is formed by punching from stainless steel plate, aluminum plate or other plates. The bottom cover is welded to the inner wall of the lower end of the cylinder body and kept flush with the lower end face of the cylinder body, so as to improve the rigidity of the lower end of the cylinder body. When the bottom cover is formed by punching, the connecting cylinder is formed by reasonably drawing the material in the center of the bottom cover for processing connecting threads to screw with connecting sleeve threads to fix the faucet shell. The connecting cylinder can ensure the overall strength and rigidity of the bottom cover.

A faucet made of such faucet shell: internal threads are arranged on the inner wall and external threads are arranged on the outer wall of the valve element mounting cylinder at its open end; the valve element mounting cylinder is provided with a valve element for controlling the on/off of water flow between the inlet pipes and the water outlet, and a valve element gland is screwed on the internal threads for fixing the valve element; it also comprises an outlet pipe, the outlet pipe comprises an outlet nozzle and an outlet channel connected to the outlet nozzle; the outlet pipe is provided with an upper mounting hole and a lower mounting hole which are concentric with each other and connected to the outlet channel; the valve element mounting cylinder passes through the upper and lower mounting holes of the outlet pipe; the end face groove is provided with a sealing ring; a lock nut is screwed on the outer threads to fix the outlet pipe on the valve element mounting cylinder, and enable one side of the outlet pipe provided with the lower mounting hole to contact the sealing ring and to be sealed, so as to connect the interlayer between the outer wall of the valve element mounting cylinder and the inner wall of the welding cylinder to the outlet channel.

The above structure shows that the interlayer between the outer wall of the valve element mounting cylinder and the inner wall of the welding cylinder is used as a water diversion cavity to introduce water from the water outlet into the outlet channel, and then discharge from the outlet pipe.

Further, the present invention proposes that an upper sealing ring is arranged between the valve element mounting cylinder and the upper mounting hole.

The above structure shows that the upper sealing ring is used to seal the gap between the inner wall of the upper mounting hole and the outer wall of the valve element mounting cylinder to avoid water leakage.

Further, the present invention proposes that an upper sealing ring is arranged between the lock nut, the valve element mounting cylinder and the upper mounting hole of the outlet valve.

The above structure shows that the upper sealing ring is used to seal the gap between the lock nut, the valve element mounting cylinder and the upper mounting hole of the outlet valve to avoid water breakthrough.

The present invention has the following beneficial effects: the cylinder body is formed by directly cutting tubular profiles such as stainless steel pipe and aluminum pipe, and the cover is formed by punching from stainless steel plate, aluminum plate or other plates. The outer edge of the cover is preferably welded to the inner wall of the cylinder body at its upper end and kept neatly flush with the end face of the cylinder body. The through hole is arranged in the center of the cover for welding the valve element mounting cylinder. Since the positional relationship between the valve element mounting cylinder and the through hole can be adjusted by movement before assembly, the overhangs of the valve element mounting cylinder can be controlled according to different faucet models to ensure the overall aesthetics and coordination after faucet assembly and avoid one-mold-one-object defect existing in casting process; the overall faucet shell is formed by welding the cover punched from sheet plate to effectively avoid many problems in existing faucet shell casting process and follow-up overall surface polishing and electroplating, such as complicated production process, high production cost, and low production efficiency, thus to effectively reduce production cost, lower finished faucet prices, and increase competitiveness while the appearance, performance and corrosion resistance remain unchanged.

DESCRIPTION OF THE REFERENCE NUMERALS

10—Cylinder body; 11—Cover; 111—Through hole; 112—Welding cylinder; 1121—Closing; 113—End face groove; 12—Valve element mounting cylinder; 121—Opening; 1211—Internal thread; 1212—External thread; 122—Bottom cover; 1221—Inlet pipe; 1222—Valve element locating hole; 123—Water outlet; 13—Valve element; 131—Locating pin; 14—Sealing ring; 15—Bottom cover; 151—Connecting cylinder; 152—Connecting thread; 16—Valve element gland; 17—Outlet pipe; 171—Outlet nozzle; 172—Outlet channel; 173—Upper mounting hole; 174—Lower mounting hole; 18—Lock nut; 19—Handle; A—Interlayer.

DETAILED DESCRIPTION OF PREFERRED EMBODIMENTS

The implementation of the present invention will be described in further detail below with reference to the accompanying drawings and embodiments. The following embodiments are used to illustrate the present invention, but do not limit the scope of the present invention.

Embodiment 1

Figure 1:
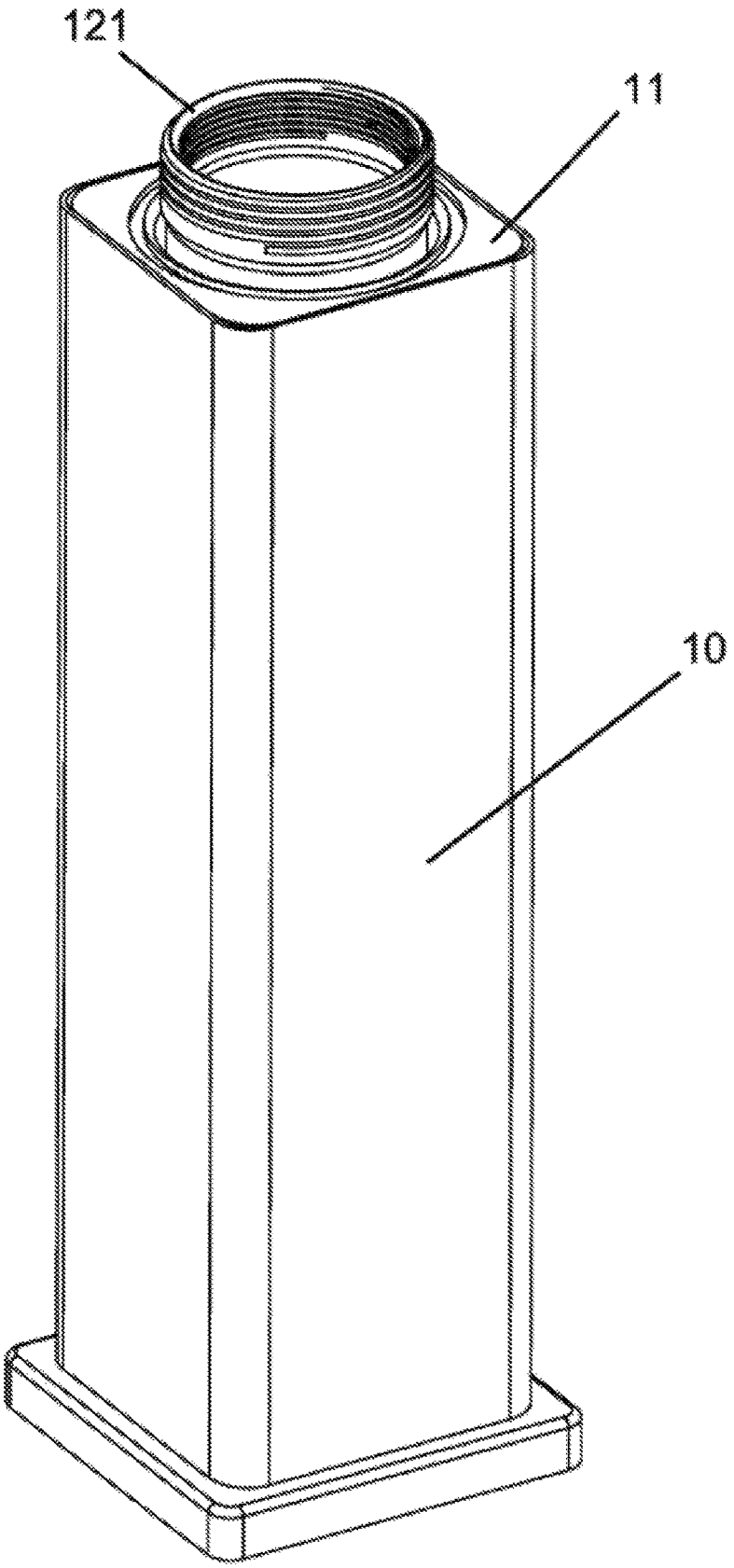
FIG. 1 is an overall diagram of the structure in Embodiment 1 of the present invention.
Figure 2:
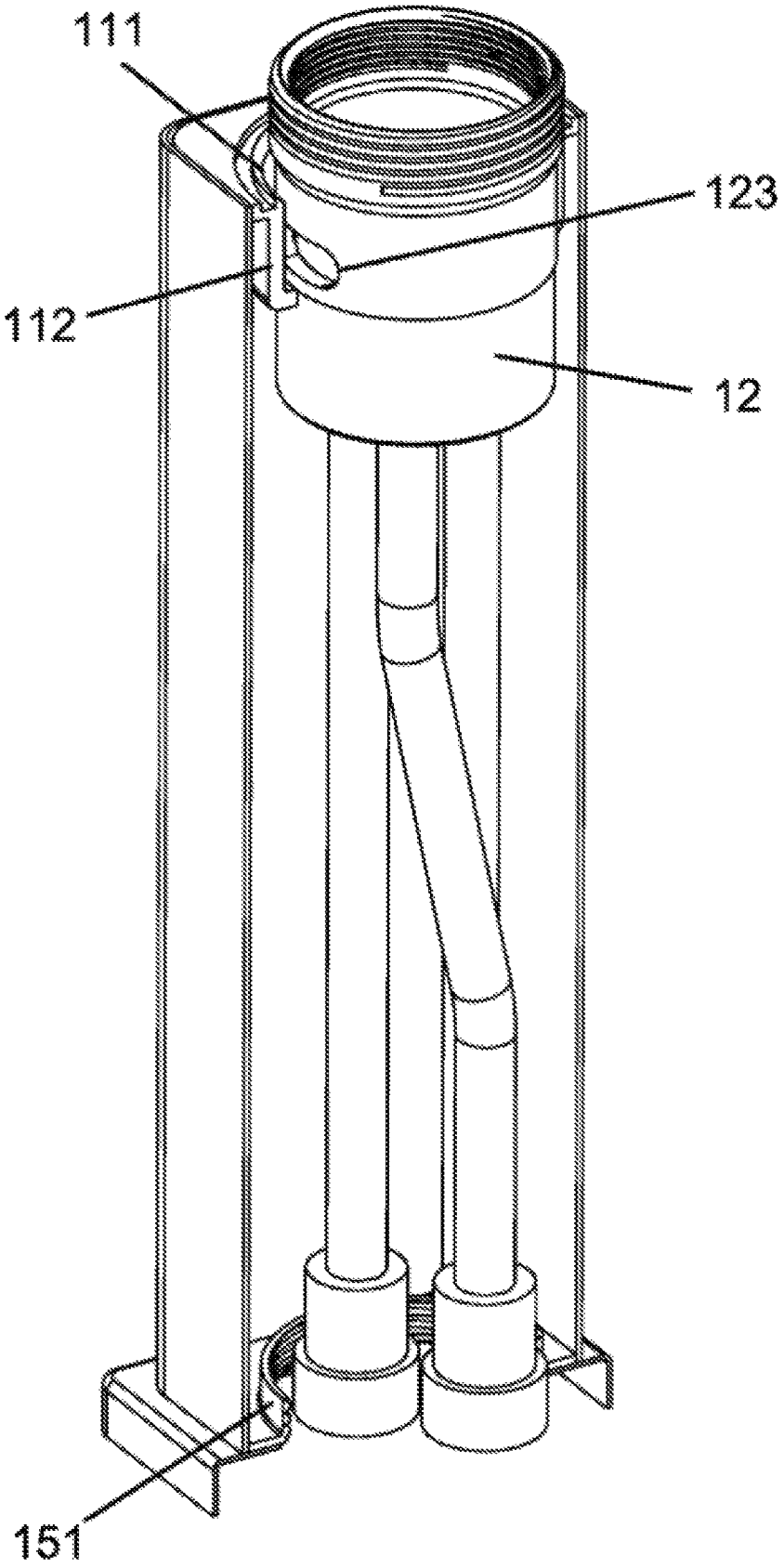
FIG. 2 is a full-section diagram of the structure in Embodiment 1 of the present invention.
Figure 3:
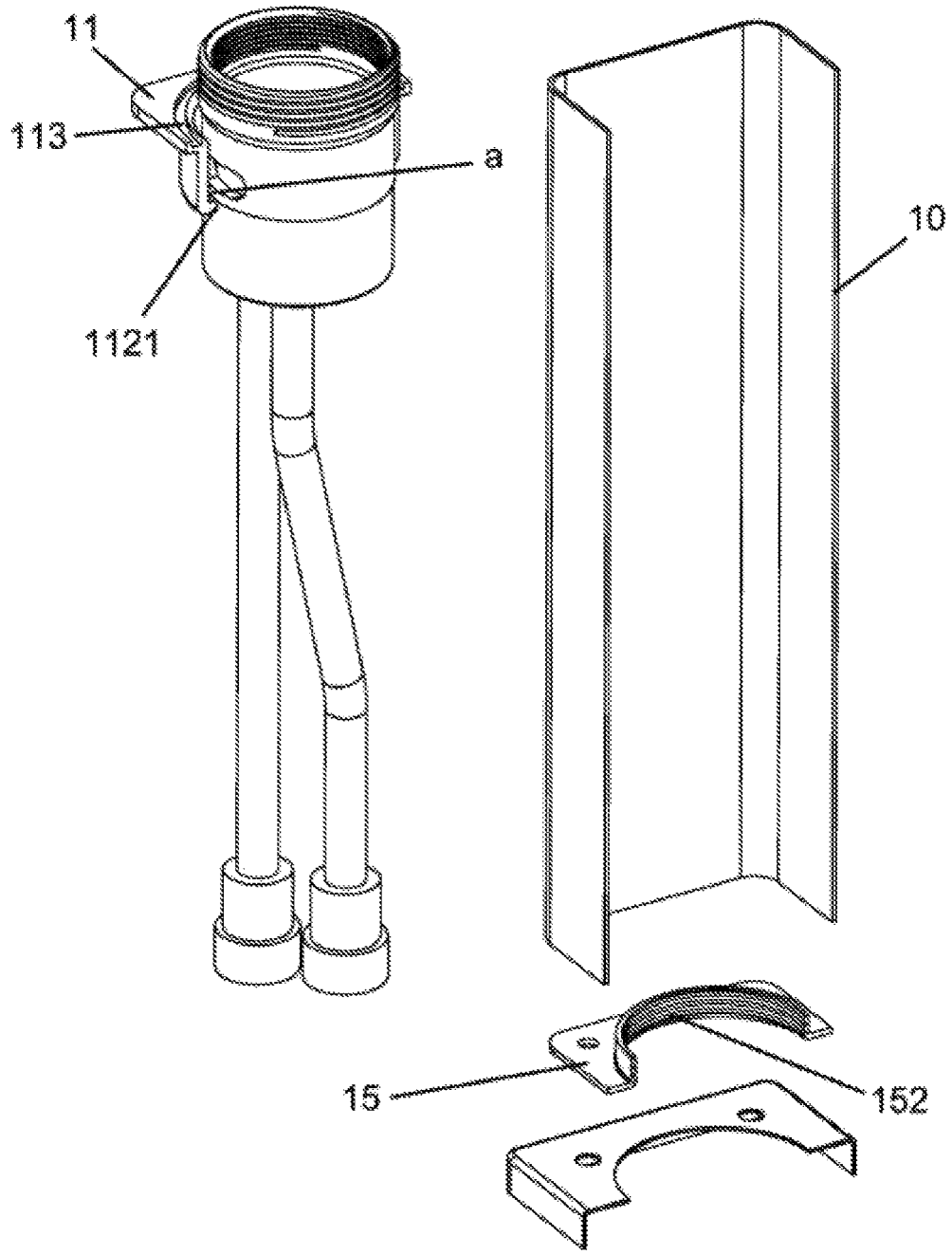
FIG. 3 is an explosive diagram of the structure in Embodiment 1 the present invention.
Figure 5:
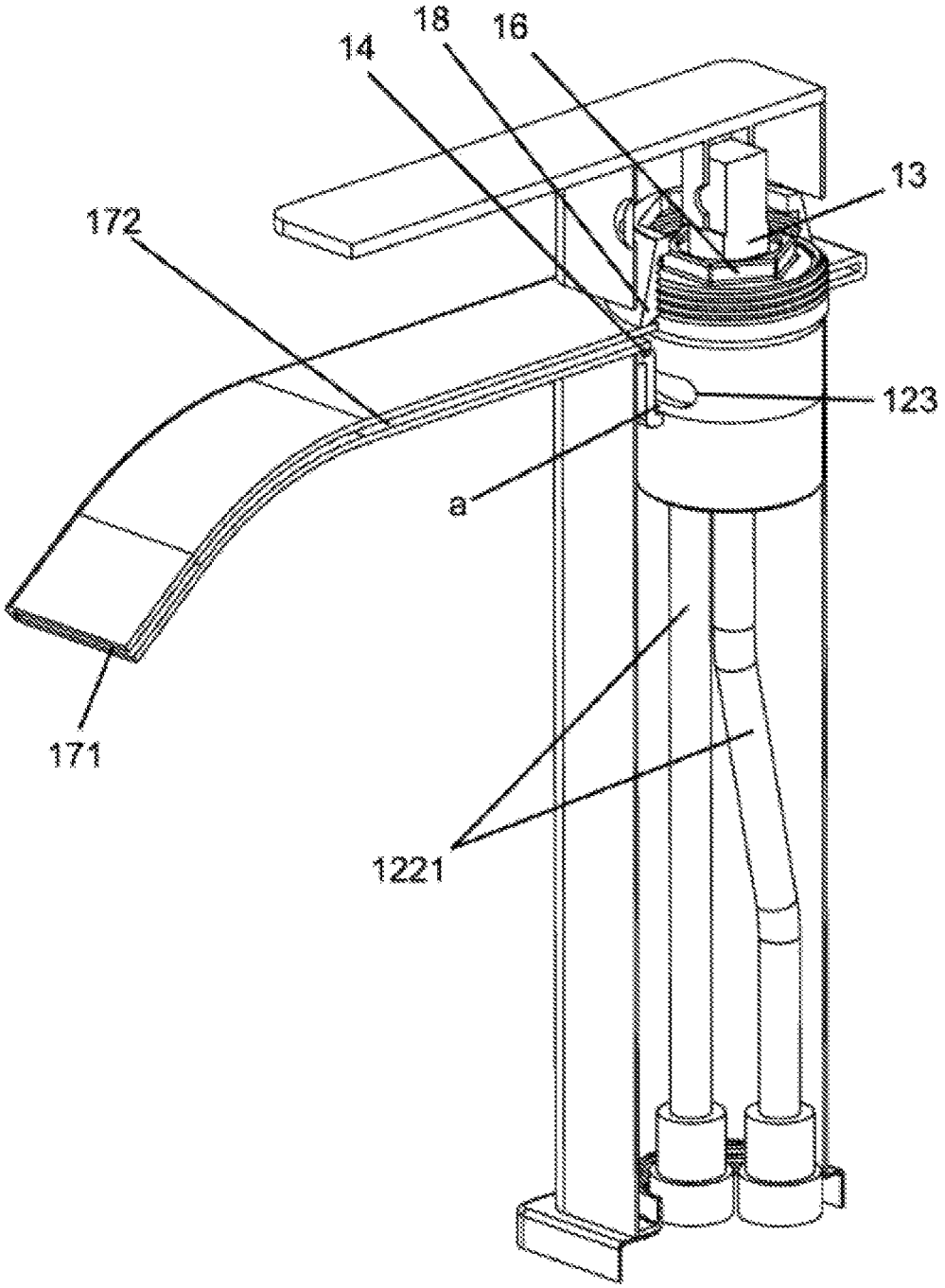
FIG. 5 is a full-section diagram of the structure in Embodiment 2 of the present invention.
Figure 8:
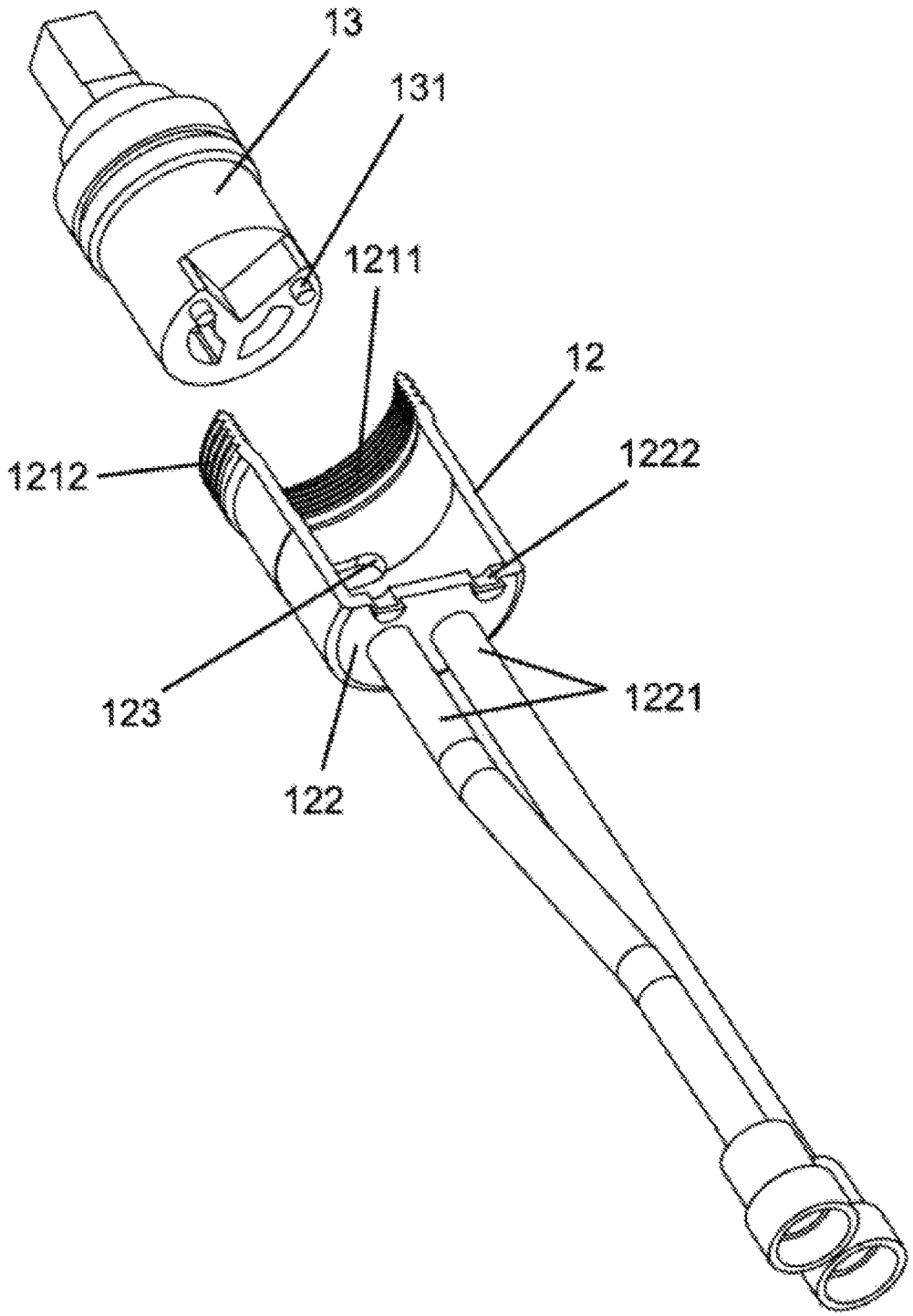
FIG. 8 is a structural schematic diagram of the valve element mounting cylinder in Embodiment 1 of the present invention.

As shown in FIGS. 1, 2, 3, 5 and 8, the faucet shell is provided, comprising the cylinder body 10 formed by cutting tubular profile, and the cover 11 formed by punching from sheet plate. The outer edge of the cover 11 is welded to the upper end face of the cylinder body 10 or the inner wall of the upper end of the cylinder body 10. The through hole 111 is arranged in the center of the cover 11, and the valve element mounting cylinder 12 is welded at the through hole 111.

The above structure shows that the cylinder body 10 is formed by directly cutting tubular profiles such as stainless-steel pipe and aluminum pipe, and the cover 11 is formed by punching from stainless steel plate, aluminum plate or other plates. The outer edge of the cover 11 is preferably welded to the inner wall of the cylinder body 10 at its upper end and kept neatly flush with the end face of the cylinder body 10. The through hole 111 is arranged in the center of the cover 11 for welding the valve element mounting cylinder 12. Since the positional relationship between the valve element mounting cylinder 12 and the through hole 111 can be adjusted by movement before assembly, the overhangs of the valve element mounting cylinder 12 can be controlled according to different faucet models to ensure the overall aesthetics and coordination after faucet assembly and avoid one-mold-one-object defect existing in casting process; the overall faucet shell is formed by welding the cover 11 punched from steel plate to effectively avoid many problems in existing faucet shell casting process and follow-up overall surface polishing and electroplating, such as complicated production process, high production cost, and low production efficiency, thus to effectively reduce production cost, lower finished faucet prices, and increase competitiveness while the appearance, performance and corrosion resistance remain unchanged.

In this embodiment, the welding cylinder 112 formed by punching and drawing material in the hole is arranged at the through hole 111 in the center of the cover 11, the welding cylinder 112 extends toward the lower end of the cylinder body 10, the outer wall of the valve element mounting cylinder 12 is welded to the welding cylinder 112, and the opening 121 is arranged at one end of the valve element mounting cylinder 12 facing the upper end face of the cylinder body 10.

The above structure shows that when the through hole 111 is punched out from the cover 11, the welding cylinder 112 is produced by reasonably drawing material in the through hole 111 for welding the valve element mounting cylinder 12, so as to ensure the overall strength and rigidity of the cover 11. The valve element mounting cylinder 12 is used for mounting the valve element 13.

In this embodiment, the closing 1121 is arranged at the extended end of the welding cylinder 112, the outer wall of the valve element mounting cylinder 12 is welded to the closing 1121, and spaced apart from the inner wall of the welding cylinder 112.

The above structure shows that the closing 1121 can ensure the smooth welding of the welding cylinder 112 to the valve element mounting cylinder 12, and reduce the risk of penetration welding.

In this embodiment, the valve element mounting cylinder 12 is formed by cutting tubular profile, the bottom cover 122 is welded to one end of the valve element mounting cylinder 12 facing the lower end of the cylinder body 10, the inlet pipes 1221 are welded to the bottom cover 122, the water outlet 123 is arranged on the side wall of the valve element mounting cylinder 12, and the water outlet 123 is arranged in the welding cylinder 112.

The above structure shows that the valve element mounting cylinder 12 formed by cutting tubular profile can reduce production cost, and that with appropriate length and diameter can be used according to actual specifications of the valve element 13. The bottom cover 122 is integrally welded to the valve element mounting cylinder 12 to form a cavity for placing the valve element 13 later. The valve element 13 is placed against the bottom cover 122 and connected to the inlet pipes 1221 thus to control the on-off of water flow between the inlet pipes 1221 and the water outlet 123 to allow water to flow from the water outlet 123 into the interlayer A between the welding cylinder 112 and the valve element mounting cylinder 12; the inlet pipes 1221 comprise a cold water pipe and a hot water pipe. A hot and cold water valve element can be used as the valve element 13 to adjust the temperature of outlet water to match hot and cold water faucets.

In this embodiment, the valve element locating hole 1222 formed by punching is arranged on one side of the bottom cover 122 facing the inner cavity of the valve element mounting cylinder 12.

The above structure shows that the valve element locating pole 1222 matches the locating pin 131 at the bottom of the valve element 13 to avoid mistakes in the installation of the valve element 13. Compared with existing drilling method, the punching method can directly form valve element locating pole saving time and effort.

In this embodiment, the groove 113 is arranged around the through hole 11 or the welding cylinder 112 on one end of the cover 11 facing the upper end face of the cylinder body 10.

The above structure shows that the end face groove 113 is used to install the sealing ring 14 when the faucet is assembled later.

In this embodiment, the bottom cover 15 punched from sheet plate is arranged at the lower end of the cylinder body 10 and welded to the end face or inner wall of the cylinder body 10 at its lower end; the connecting cylinder 151 formed by punching and drawing material in the hole is arranged in the upper center of the bottom cover 15 and extends toward the upper end of the cylinder body 10; the inner wall of the connecting cylinder 151 is provided with the connection threads 152.

The above structure shows that the bottom cover 15 is formed by punching from stainless steel plate, aluminum plate or other plates. The bottom cover 15 is welded to the inner wall of the lower end of the cylinder body 10 and kept flush with the lower end face of the cylinder body 10, so as to improve the rigidity of the lower end of the cylinder body 10. When the bottom cover 15 is formed by punching, the connecting cylinder 151 is formed by reasonably drawing material in the center of the bottom cover 15 for processing the connecting threads 152 to screw with the connecting sleeve (not shown in the figure) threads to fix the faucet shell. The connecting cylinder 151 can ensure the overall strength and rigidity of the bottom cover 15.

Embodiment 2

Figure 4:
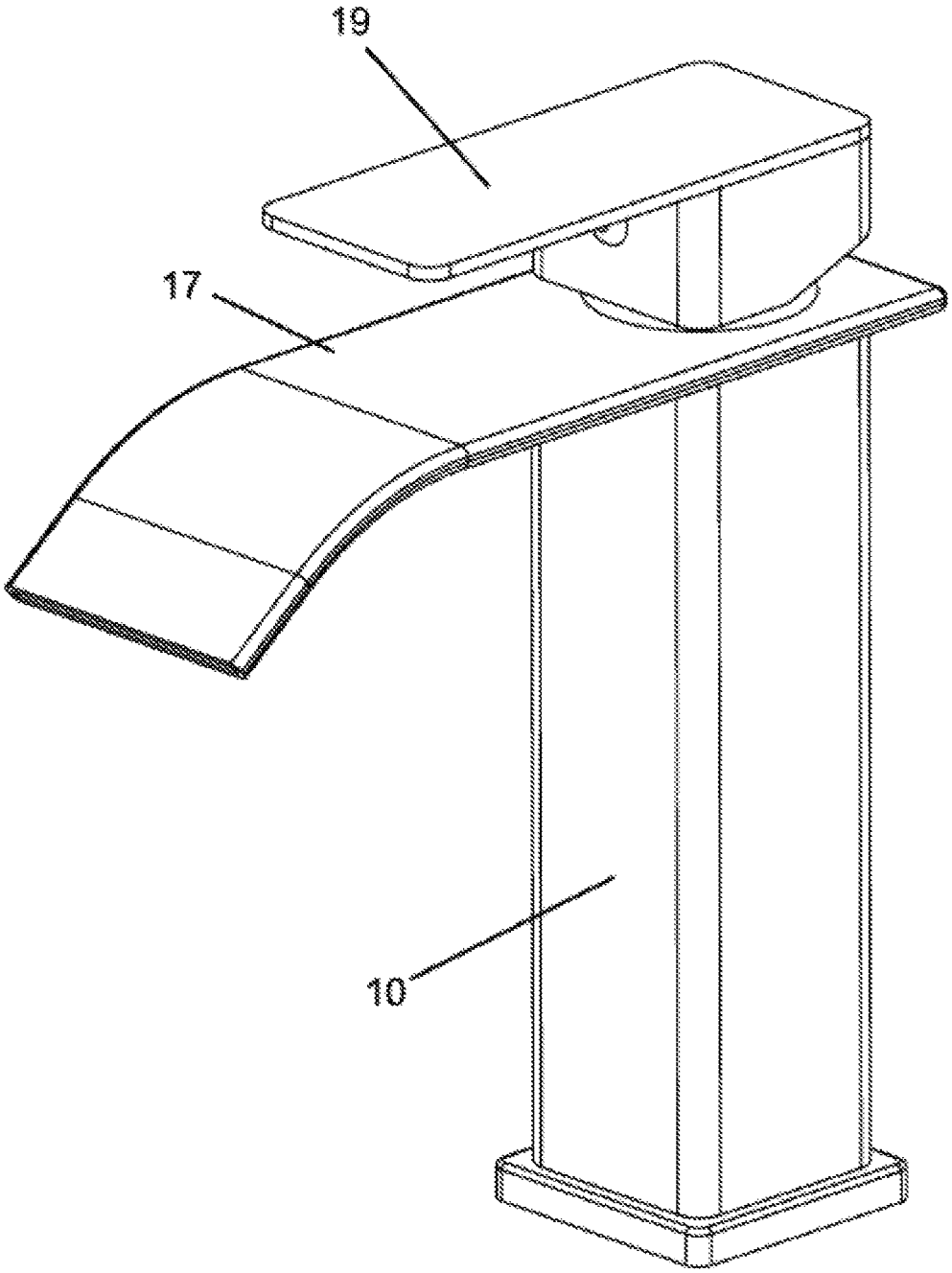
FIG. 4 is an overall diagram of the structure in Embodiment 2 of the present invention.
Figure 6:
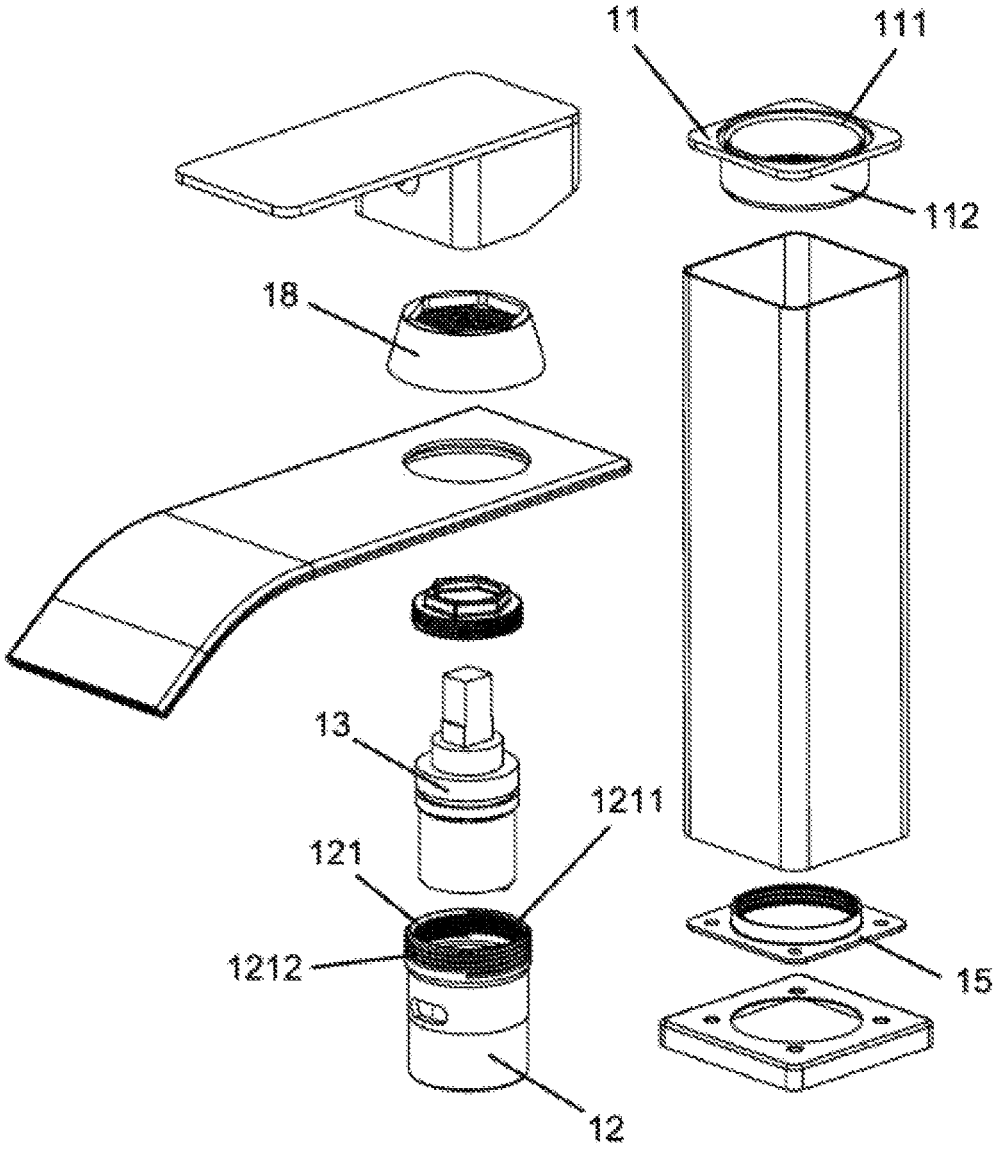
FIG. 6 is an explosive diagram of the structure in Embodiment 2 the present invention.
Figure 7:
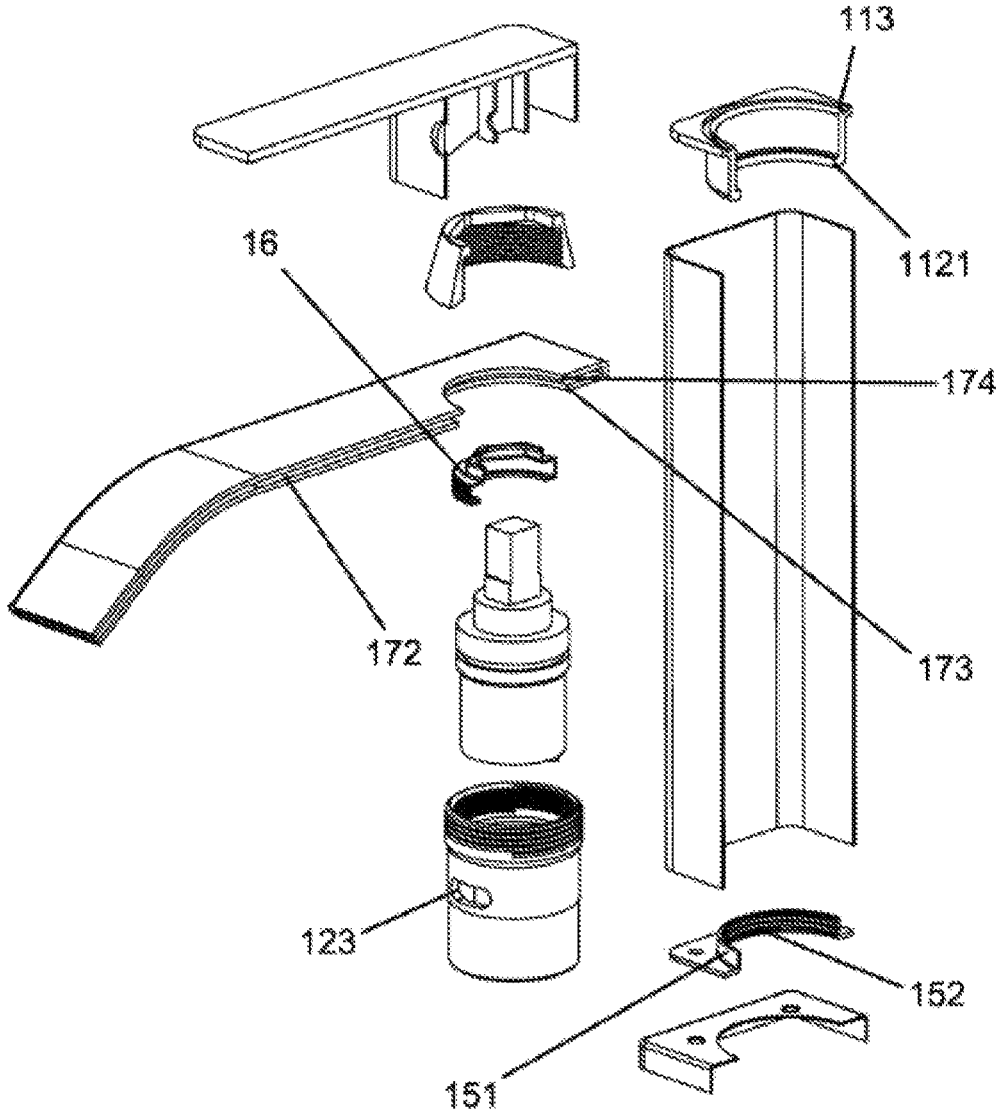
FIG. 7 is a full-section explosive diagram of the structure in Embodiment 2 the present invention.

As shown in FIGS. 1 to 8, the faucet is proposed, comprising the faucet shell in Embodiment 1; the internal threads 1211 are arranged on the inner wall and the external threads 1212 are arranged on the outer wall of the valve element mounting cylinder 12 at its open end; the valve element mounting cylinder 12 is provided with the valve element 13 for controlling the on/off of water flow between the inlet pipes 1221 and the water outlet 123, and the valve element gland 16 is screwed on the internal threads 1211 for fixing the valve element 13; it also comprises the outlet pipe 17, the outlet pipe 17 comprises the outlet nozzle 171 and the outlet channel 172 connected to the outlet nozzle 171; the outlet pipe 17 is provided with the upper mounting hole 173 and the lower mounting hole 174 which are concentric with each other and connected to the outlet channel 172; the valve element mounting cylinder 12 passes through the upper mounting hole 173 and the lower mounting hole 174 of the outlet pipe 17; the end face groove 113 is provided with the sealing ring 14; the lock nut 18 is screwed on the outer threads 1212 to fix the outlet pipe 17 on the valve element mounting cylinder 12, and enable one side of the outlet pipe 17 provided with the lower mounting hole 174 to contact the sealing ring 14 and to be sealed, so as to connect the interlayer A between the outer wall of the valve element mounting cylinder 12 and the inner wall of the welding cylinder 112 to the outlet channel 172.

The above structure shows that the interlayer A between the outer wall of the valve element mounting cylinder 12 and the inner wall of the welding cylinder 112 is used as a water diversion cavity to introduce water from the water outlet 123 into the outlet channel 172, and then discharge from the outlet pipe 17.

In this embodiment, an upper sealing ring (not shown in the figure) is arranged between the valve element mounting cylinder 12 and the upper mounting hole 173.

The above structure shows that the upper sealing ring is used to seal the gap between the inner wall of the upper mounting hole 173 and the outer wall of the valve element mounting cylinder 12 to avoid water breakthrough.

In this embodiment, an upper sealing ring (not shown in the figure) is arranged among the lock nut 18, the valve element mounting cylinder 12 and the upper mounting hole 173 of the outlet valve 17.

The above structure shows that the upper sealing ring is used to seal the gap among the lock nut 18, the valve element mounting cylinder 12 and the upper mounting hole 173 of the outlet valve 17 to avoid water breakthrough.

In this embodiment, the valve element 13 is provided with the handle 19.

The present invention has the following beneficial effects: the cylinder body 10 is formed by directly cutting tubular profiles such as stainless-steel pipe and aluminum pipe, and the cover 11 is formed by punching from stainless steel plate, aluminum plate or other plates. The outer edge of the cover 11 is preferably welded to the inner wall of the cylinder body 10 at its upper end and kept neatly flush with the end face of the cylinder body 10. The through hole 111 is arranged in the center of the cover 11 for welding the valve element mounting cylinder 12. Since the positional relationship between the valve element mounting cylinder 12 and the through hole 111 can be adjusted by movement before assembly, the overhangs of the valve element mounting cylinder 12 can be controlled according to different faucet models to ensure the overall aesthetics and coordination after faucet assembly and avoid one-mold-one-object defect existing in casting process; the overall faucet shell is formed by welding the cover 11 punched from steel plate to effectively avoid many problems in existing faucet shell casting process and follow-up overall surface polishing and electroplating, such as complicated production process, high production cost, and low production efficiency, thus to effectively reduce production cost, lower finished faucet prices, and increase competitiveness while the appearance, performance and corrosion resistance remain unchanged.

The foregoing is only the preferred embodiments of the present invention. It will be appreciated by those of ordinary skills in the art that some improvements and modifications may be made thereto without departing from the technical principles of the present invention and such improvements and modifications of the above assumptions should fall within the protection scope of the present invention.

What is claimed is:

1. A faucet shell, wherein it comprises a cylinder body formed by cutting tubular profile, and a cover formed by punching from steel plate; The outer edge of the cover is welded to the upper end face of the cylinder body or inner wall of the upper end of the cylinder body; a through hole is arranged in the center of the cover, and a valve element mounting cylinder is welded at the through hole and wherein a welding cylinder formed by punching and drawing material in the hole is arranged at the through hole in the center of the cover, the welding cylinder extends toward the lower end of the cylinder body, the outer wall of the valve element mounting cylinder is welded to the welding cylinder, and an opening is arranged at one end of the valve element mounting cylinder facing the upper end face of the cylinder body and wherein a closing is arranged at the extended end of the welding cylinder, the outer wall of the valve element mounting cylinder is welded to the closing, and the outer wall of the valve element mounting cylinder is spaced apart from the inner wall of the welding cylinder and wherein the valve element mounting cylinder is formed by cutting tubular profile, a bottom cover is welded to one end of the valve element mounting cylinder facing the lower end of the cylinder body, inlet pipes are welded to the bottom cover, a water outlet is arranged on the side wall of the valve element mounting cylinder, and the water outlet is arranged in the welding cylinder.

2. The faucet shell according to claim 1, wherein a valve element locating hole formed by punching is arranged on one side of the bottom cover facing the inner cavity of the valve element mounting cylinder.

3. The faucet shell according to claim 2, wherein a groove is arranged around the through hole or the welding cylinder on one side of the cover facing the upper end face of the cylinder body.

4. The faucet shell according to claim 3, wherein the bottom cover formed by punching from sheet plate is arranged at the lower end of the cylinder body and welded to the end face or inner wall of the cylinder body at its lower end; a connecting cylinder formed by punching and drawing material in the hole is arranged in the upper center of the bottom cover and extends toward the upper end of the cylinder body; the inner wall of the connecting cylinder is provided with connection threads.

5. A faucet made of such faucet shell according to claim 4, wherein internal threads are arranged on the inner wall and external threads are arranged on the outer wall of the valve element mounting cylinder at its open end; the valve element mounting cylinder is provided with a valve element for controlling the on/off of water flow between the inlet pipe and the water outlet, and a valve element gland is screwed on the internal threads for fixing the valve element; it also comprises an outlet pipe that comprises an outlet nozzle and an outlet channel connected to the outlet nozzle; the outlet pipe is provided with an upper mounting hole and a lower mounting hole which are concentric with each other and connected to the outlet channel; the valve element mounting cylinder passes through the upper and lower mounting holes of the outlet pipe; the end face groove is provided with a sealing ring; a lock nut is screwed on the outer threads to fix the outlet pipe on the valve element mounting cylinder, and enable one side of the outlet pipe provided with the lower mounting hole to contact the sealing ring and to be sealed, so as to connect the interlayer between the outer wall of the valve element mounting cylinder and the inner wall of the welding cylinder to the outlet channel.

6. The faucet according to claim 5, wherein an upper sealing ring is arranged between the valve element mounting cylinder and the upper mounting hole.

7. The faucet according to claim 5, wherein an upper sealing ring is arranged among the lock nut, the valve element mounting cylinder and the upper mounting hole of the outlet pipe.

* * * * *